US010668516B2

(12) United States Patent
Zhou et al.

(10) Patent No.: US 10,668,516 B2
(45) Date of Patent: Jun. 2, 2020

(54) POST-COMPRESSION FOR SPRINGBACK REDUCTION

(71) Applicants: Dajun Zhou, Troy, MI (US); Changqing Du, Troy, MI (US)

(72) Inventors: Dajun Zhou, Troy, MI (US); Changqing Du, Troy, MI (US)

(73) Assignee: FCA US LLC, Auburn Hills, MI (US)

( * ) Notice: Subject to any disclaimer, the term of this patent is extended or adjusted under 35 U.S.C. 154(b) by 704 days.

(21) Appl. No.: 15/254,493

(22) Filed: Sep. 1, 2016

(65) Prior Publication Data

US 2018/0056361 A1 Mar. 1, 2018

(51) Int. Cl.
*B21D 5/01* (2006.01)
*B21D 22/30* (2006.01)
*B21D 22/22* (2006.01)

(52) U.S. Cl.
CPC ..... *B21D 5/01* (2013.01); *B21D 22/22* (2013.01); *B21D 22/30* (2013.01)

(58) Field of Classification Search
CPC ..... B21D 5/01; B21D 22/04; B21D 22/06; B21D 22/22; B21D 22/24; B21D 22/225; B21D 22/30; B21D 43/26; B21D 22/10
USPC ..... 72/702, 361
See application file for complete search history.

(56) References Cited

U.S. PATENT DOCUMENTS 4,373,371 A 2/1983 Liu
8,296,922 B2 10/2012 Flehmig et al.
8,857,237 B2 * 10/2014 Chien ..... B21D 22/22 72/347
2014/0000336 A1 * 1/2014 Alm ..... B21D 5/01 72/379.2
2016/0144418 A1 * 5/2016 Nakamura ..... B21D 22/30 72/349

FOREIGN PATENT DOCUMENTS

FR 1237306 A * 7/1960 ..... B21D 22/30

OTHER PUBLICATIONS

Franghia, Machine translation of FR 1237306 A, translated on Dec. 31, 2018, pp. 1-3 (Year: 2018).*
Ayers, R.A.; "SHAPESET: A Process to Reduce Sidewall Curl Springback in High-Strength Steel Rails"; J. Applied Metalworking; 1984 American Society for Metals; vol. 3, No. 2, Jan. 1984; pp. 127-134.

(Continued)

*Primary Examiner* — Teresa M Ekiert
(74) *Attorney, Agent, or Firm* — Ralph E Smith

(57) ABSTRACT

A sheet metal material is stamped into a formed shape having a side wall between a central portion and a flange portion. The central portion is held between an upper pad and a die, and the flange portion is held between an upper binder and a lower binder. A post-stamping compression force is applied along a length of the side wall of the formed shape. For example, application of the post-stamping compression force includes moving the lower binder relatively toward the upper pad, such as by delaying a return of the upper pad during a portion of a return of the lower binder. During application of the post-stamping compression force, an outward force is applied against an inner surface of the side wall to insure any bowing of the side wall is in an outward direction.

8 Claims, 3 Drawing Sheets

(56) References Cited

OTHER PUBLICATIONS

Aryanpour, Ali; "Experimental and Numerical Analysis of Sidewall Curl in Advanced High Strength Steels"; University of Windsor; Electronic Theses and Dissertations; Paper 171; Oct. 18, 2011.
Abe, Shigeki et al.; "Optimum Draw-beads Design for Stepped-shape Beam Forming to Suppress Wrinkle and Torsional Springback"; 9th World Congress on Structural and Multidisciplinary Optimization; Jun. 13-17, 2011; Shizuoka, Japan; pp. 1-8.
Radonjic, R. and Liewald, M.; "Springback behavior in forming of ultra high-strength sheet metals"; University of Stuttgart, Institute for Metal Forming Technology (IFU), Holzgartenstrasse 17, 70174 Stuttgart, Germany; International Deep Drawing Research Group; IDDRG 2016 International Conference; Jun. 12-15, 2016; Linz, Austria; pp. 590-597.
Radonjic, Ranko; "Springback Behavior in Forming of Ultra High-Strength Sheet Metals" presentation slide shots; Institute for Metal Forming Technology, University of Stuttgart; presented on Jun. 14, 2016.

* cited by examiner

POST-COMPRESSION FOR SPRINGBACK REDUCTION

FIELD

The present disclosure relates to sheet metal stamping processes for reducing springback.

BACKGROUND

Sheet metal that is subjected to a metal stamping process often will springback toward its original shape such that angles formed in the stamped part will be larger than those of the corresponding stamping tool. Springback can result in angular changes of the side wall, side wall curl, or twist or torsion springback. It is desirable to reduce such springback to improve dimensional and shape quality and consistency in the stamped parts.

Traditionally, side wall curl spring back is controlled using a post-forming stretching operation. For example, stake beads are typically used to engage a flanged portion of the part to apply a post-stretch or tension to side walls of the part. The deformations caused by the stake beads are subsequently removed and discarded.

Such post-stretching processes to control springback require an additional width of wasted flange material on all sides of the part. The waste material and the additional process steps and equipment required to remove and discard the waste material add costs and reduce operational efficiency and throughput. In addition, the stake bead forming die elements tend to wear prematurely relative to the other die elements.

In addition, many sheet metal materials, including high strength aluminum and high strength steel, tend to exhibit relatively poor formability or ductility. In other words, such material will tend to exhibit cracking when subjected to relatively small amounts of stretching and bending. For such materials, the use of post-stretching process requires additional formability, ductility, or stretchability beyond that required to form the part, which serves to further limit the shapes of parts that these materials can form.

SUMMARY

In an aspect of the present disclosure, a metal stamping process with post-compression to control springback includes stamping a sheet metal material into a formed shape having a side wall, and applying a post-stamping compression force along a length of the side wall of the formed shape.

In an aspect of the present disclosure, the stamping includes holding a central portion of the sheet metal between an upper pad and a die, and holding a flange portion of the sheet metal between an upper and a lower binder. The central portion is adjacent an upper end of the side wall and the flange portion is adjacent a lower end of the side wall. Application of the post-stamping compression force includes moving the lower binder relatively toward the upper pad. In a further aspect, moving the lower binder and the upper pad relatively toward each other includes delaying a return of the upper pad during a portion of a return of the lower binder.

In an aspect of the present disclosure, the metal stamping process additionally includes applying an outward force against an inner surface of the side wall during the applying the post-stamping compression force to insure any bowing of the side wall during the applying the post-stamping compression force is in an outward direction.

In a further aspect of the present disclosure, applying the outward force includes extending at least one projection through a corresponding aperture in the die to engage the inner surface of the side wall. In a further aspect, applying the outward force includes extending at least one projection through a corresponding aperture in the die to engage the inner surface of the side wall. In another further aspect, extending at least one projection includes engaging cooperating cam surfaces of an upper cam member and a lower cam member, respectively, against each other.

In an aspect of the present disclosure, stamping includes holding a central portion of the sheet metal between an upper pad and a die, and holding a peripheral portion of the sheet metal between an upper binder and a lower binder. The central portion is adjacent an upper end of the side wall and the peripheral portion is adjacent a lower end of the side wall. Applying the post-stamping compression force and extending at least one projection includes moving the lower binder and lower cam member relatively toward the upper pad and the lower cam member. In a further aspect, moving the lower binder and lower cam member relatively toward the upper pad and upper cam member includes delaying a return of the upper pad and the upper cam member during a portion of a return of the lower binder and the lower cam member.

DRAWINGS

The present invention will become more fully understood from the detailed description and the accompanying drawings.

DETAILED DESCRIPTION

Figure 1:
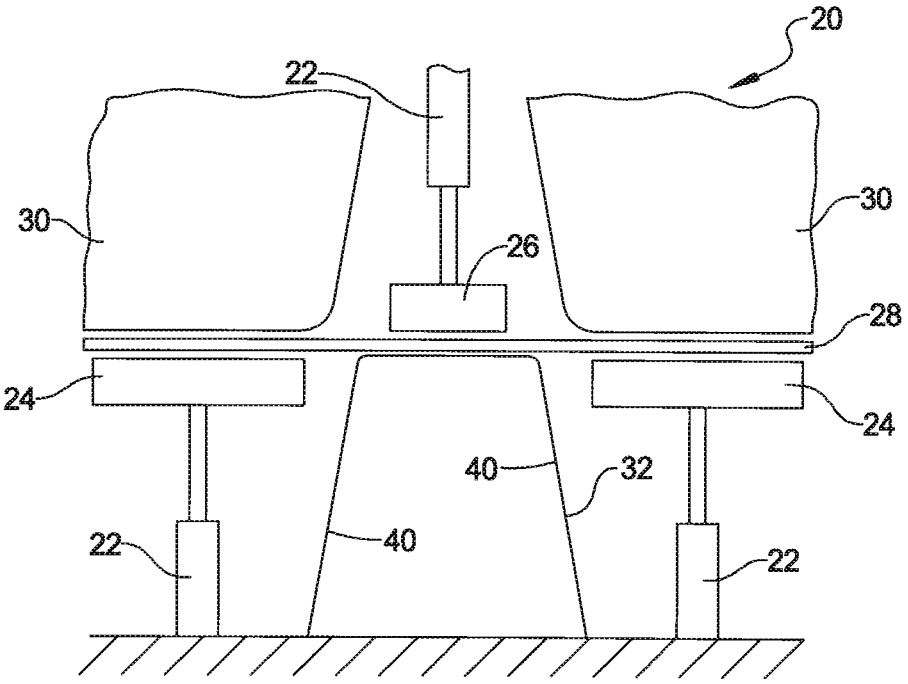
FIG. 1 is a simplified partial elevation representational view of a metal stamping tool useful for performing the stamping and post-compression process in accordance with an aspect of the disclosure, positioned at the beginning of a stamping operation.

Further areas of applicability will become apparent from the description, claims and drawings, wherein like reference numerals refer to like features throughout the several views of the drawings. It should be understood that the detailed description, including disclosed embodiments and drawings referenced therein are merely exemplary in nature, intended for purposes of illustration only, and are not intended to limit the scope of the present disclosure.

Figure 2:
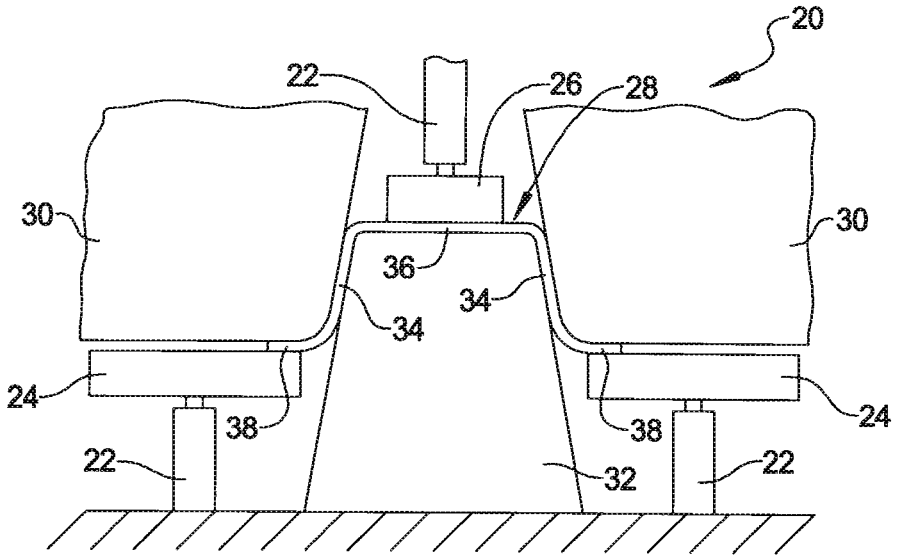
FIG. 2 is a simplified partial elevation representational view of the metal stamping tool of FIG. 1, but with the components positioned at the end of a stamping operation.

In the illustrated exemplary embodiment representation of FIG. 1 and FIG. 2, a metal stamping tool 20 includes an upper pad 26 lower binders 24, each supported by a respective spring 22. The lower binders 24 each oppose a respective upper binder 30 and the upper pad 26 opposes a stationary post or die 32. The FIG. 1 illustrates an initial position of the relative components about to contact the metal sheet 28 being stamped, while FIG. 2 illustrates a final position of the relative components. It is worth noting that the width of the flange need only be sufficient to form the flange itself. The material width does not need to be sufficient to form any other features, such as stake beads, between the upper binder 30 and the lower binder 24.

As shown in FIG. 2, the metal stamping tool 20 stamps the sheet metal material 28 into a formed shape including a side wall portion 34, a central portion 36, and lower flange portions 38. The stamping process includes holding the central portion 36 of the sheet metal 28 between the upper pad 26 and the forming post or die 32, and holding the flange portions 38 of the sheet metal between the upper binders 30 and the lower binders 24. During the stamping of such a formed shape, stresses are built up in the side wall 34 material such that the side wall 34 material holds stamping-induced compressive stress adjacent its inner surface (adjacent the die 32), and holds stamping-induced tensile stress adjacent its outer surface (away from the die 32).

Then, a post-stamping compression force is applied along the length of the side wall 34 of the formed shape (FIG. 2). Applying the post-stamping compression force includes moving the lower binders 24 relatively toward the upper pad 26. For example, after the stamping operation, the upper pad 26 and binders 24, 20 move back upward toward their home position (FIG. 1). In an aspect, moving the lower binders 24 relatively toward the upper pad 26 includes delaying the return of the upper pad 26 while the lower and upper binders 24 and 30, respectively, are returning a small distance, such as a few millimeters, toward their home positions.

In an aspect, a result of the application of the post-stamping compression force is to convert the stamping-induced tensile stress to a post-compression induced compressive stress, such that the residual material stress along the length of the side wall 34 is in compression throughout its width between its inner to outer sides. Alternatively, the magnitude of the stamping-induced tensile stress is not reversed (i.e., converted to compressive stress), but is reduced sufficiently to provide acceptable springback control.

In an aspect, additional post-stamping tensile and/or compression forces are optionally applied along the length of the side wall 34. For example, one or more cycles alternating between the application of post-stamping compression and post-stamping tensile forces are provided along the length of the side wall 34.

Figure 4:
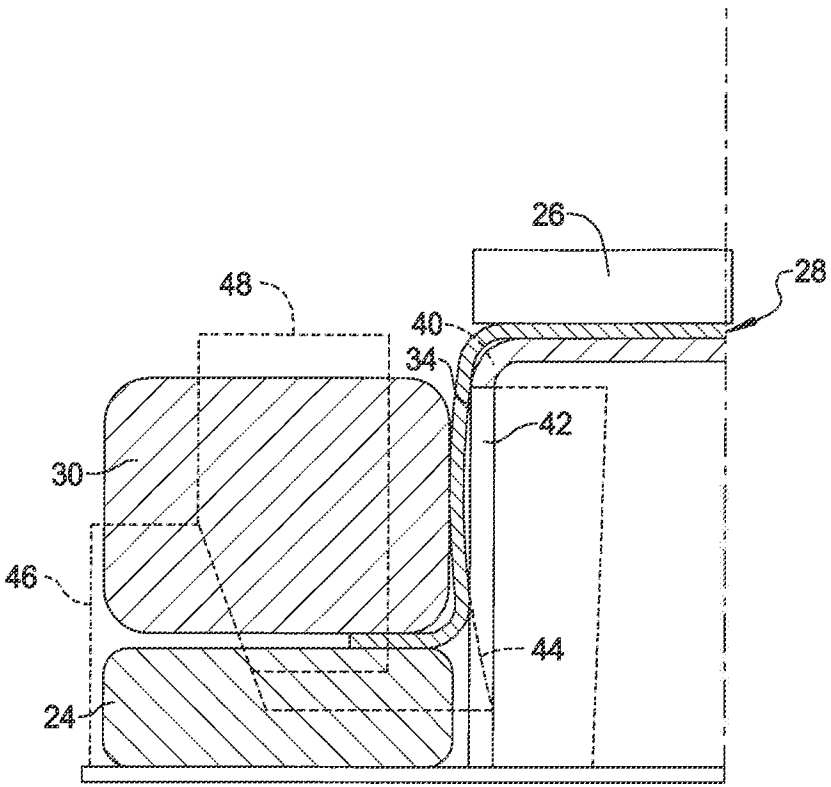
FIG. 4 is a partial cross-sectional view of the left half of a stamping tool of FIG. 3, but with the components positioned at the end of a stamping operation.
Figure 3:
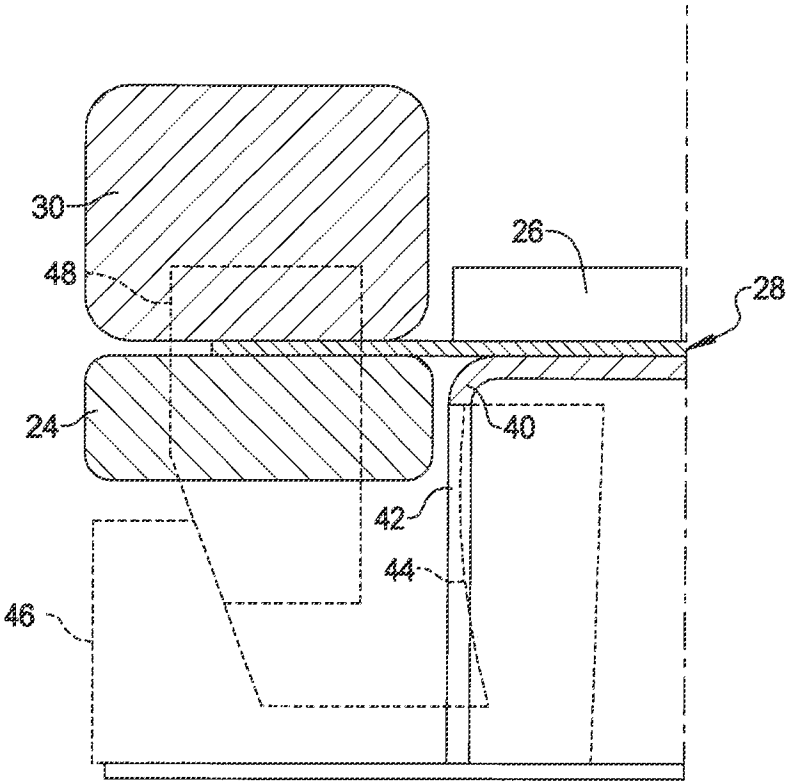
FIG. 3 is a partial cross-sectional view corresponding to the left half of a second embodiment of a stamping tool similar to that represented in FIGS. 1 and 2, positioned at the beginning of a stamping operation.
Figure 6:
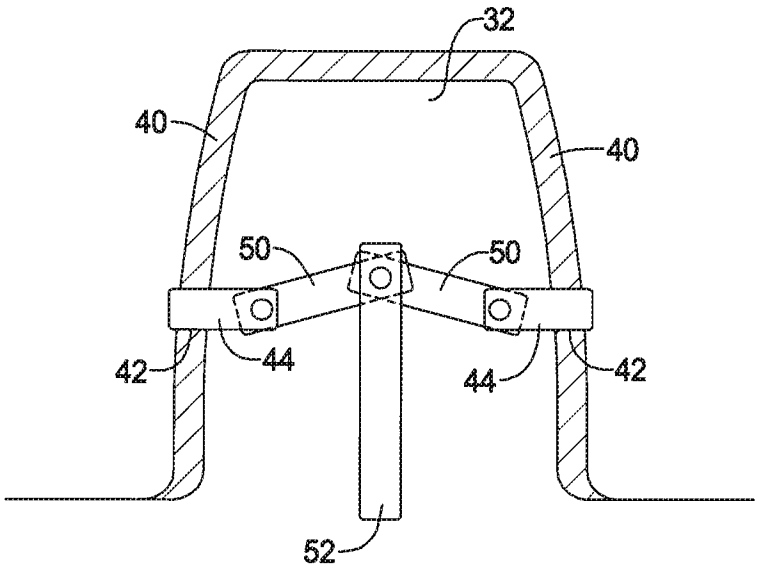
FIG. 6 is a partial cross-sectional view of the left half of a stamping tool of FIG. 5, but with the components positioned at the end of a stamping operation.
Figure 5:
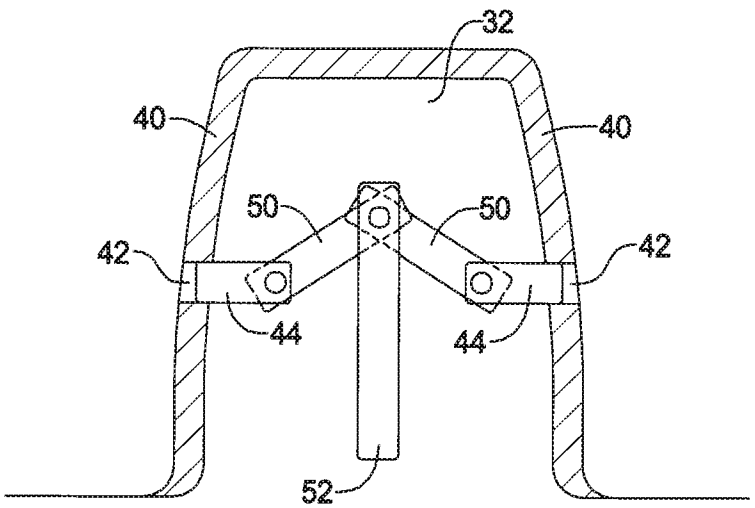
FIG. 5 is a partial cross-sectional view corresponding to the left half of a third embodiment of a stamping tool similar to that represented in FIGS. 1 and 2, positioned at the beginning of a stamping operation.

Although the representation of the stationary post or die 32 in FIGS. 1 and 2 suggests an overall trapezoidal shape with straight angled side walls 40, these side walls 40 are alternatively substantially vertical as shown in FIGS. 3 and 4, and/or somewhat outwardly bowed as shown in FIGS. 5 and 6. In addition, the side walls 40 of FIGS. 3-6 each include apertures 42 through which projections 44 extend during post-stamping compression as described hereinafter.

In an aspect, the side wall 40 is controlled or guided to insure it does not buckle, because of the instability of the side wall 40 under compression along its length. Thus, the projections 44 apply an outward force against an inner surface of the side wall 34 of the formed shape during the applying the post-stamping compression force to insure that any bowing of the side wall 34 during the applying the post-stamping compression force is in an outward direction. Thus, the side wall 34 will not adopt a snake-like or sinusoidal shape along its length during the application of the compressive force.

Referring to the example embodiment of FIGS. 3 and 4, each side wall 40 of the die 32 includes one or more elongated apertures or slots 42 through which corresponding projections 44 extend during the post-compression operation. The projections 44 of each side are movable with a cam member 46. A cooperating cam member 48 is positioned adjacent the cam member 46. The cooperating cam members 46, 48 move relative toward each other during the post-compression operation. As the cooperating cam members 46, 48 move toward each other, the projections 44 extend through the slots 42 and engage an inner surface of the side wall 34 of the formed shape causing the side walls 34 to bow outwardly during the post-compression operation.

In an aspect, the relative movement of the cooperating cam members 46, 48 is keyed to, or driven by, the relative movement of the binders 24 and the upper pad 26 during the post-compression operation. Alternatively, a separate hydraulic or electrical mechanism is used to drive the movement of the cam members 46, 48, or to directly drive the outward movement of the projections 44 through the slots 42 during the post-compression operation.

Referring to the example embodiment of FIGS. 5 and 6, each side wall 40 of the post 32 includes one or more apertures 42 through which corresponding projections 44 extend during the post-compression operation. Linkages 50 in the form of an inverted "V" shape couple the projections 44 of opposing sides of the post 32 to each other and to a drive link 52. During the post-compression operation, the drive link 52 moves downwardly causing the linkages 50 to extend the projections 44 out of the apertures 42 and engage the inner surface of the side wall 34 of the formed shape as previously described.

In an aspect, a separate hydraulic or electrical mechanism is used to drive the movement of the drive link 52 and linkages 50, or to directly drive the outward movement of the projections 44 through the apertures 42 during the post-compression operation. Alternatively, the relative movement of the drive link 52 is keyed to, or driven by, the relative movement of the binders 24 and the upper pad 26 during the post-compression operation. For example, in such an alternate embodiment the drive linkages 50 form an upright "V" shape so that upward movement of the drive link 52 causes the linkages 50 to extend the projections 44 out of the apertures 42 and engage the inner surface of the side wall 34 of the formed shape. The drive link 52 is keyed to, or driven by, the upward movement of the lower binders 24 during the delayed return of the upper pad 26 of the post-compression operation.

In yet another alternative embodiment, the stationary die or post 32 has side walls 40 with an outwardly bowed shape as shown in FIGS. 5 and 6, that is sufficient to insure the side walls 34 take a single outwardly bowed shape during the post-compression operation.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A metal stamping process including post-compression to control springbuck comprising:

stamping a sheet metal material into a formed shape having a side wall;

applying a post-stamping compression force along a length of the side wall of the formed shape;

wherein the stamping comprises holding a central portion of the sheet metal between an upper pad and a die, and holding a flange portion of the sheet metal between an upper binder and a lower binder, and wherein the central portion is adjacent an upper end of the side wall and the flange portion is adjacent a lower end of the side wall, and wherein applying the post-stamping compression force comprises moving the lower binder relatively toward the upper pad.

2. The metal stamping process of claim 1, wherein the moving the lower binder and the upper pad relatively toward each other comprises delaying a return of the upper pad during a portion of a return of the lower binder.

3. A metal stamping process including post-compression to control springback comprising:

stamping a sheet metal material into a formed shape having a side wall;

applying a post-stamping compression force along a length of the side wall of the formed shape;

applying an outward force against an inner surface of the side wall during the applying the post-stamping compression force to insure any bowing of the side wall during the applying the post-stamping compression force is in an outward direction.

4. The metal stamping process of claim 3, wherein the applying the outward force comprises extending at least one projection through a corresponding aperture in a die to engage the inner surface of the side wall.

5. The metal stamping process of claim 4, wherein the extending at least one projection comprises applying a force to a link arm coupled to the at least one projection to increase the size of an angle between the projection and the link arm.

6. The metal stamping process of claim 4, wherein the extending at least one projection comprises engaging cooperating cam surfaces of an upper cam member and a lower cam member, respectively, against each other.

7. The metal stamping process of claim 6, wherein the stamping comprises holding a central portion of the sheet metal between an upper pad and a die, and holding a peripheral portion of the sheet metal between an upper binder and a lower binder, and wherein the central portion is adjacent an upper end of the side wall and the peripheral portion is adjacent a lower end of the side wall, and wherein applying the post-stamping compression force and extending at least one projection comprises moving the lower binder and lower cam member relatively toward the upper pad and the lower cam member.

8. The metal stamping process of claim 7, wherein the moving the lower binder and lower cam member relatively toward the upper pad and upper cam member comprises delaying a return of the upper pad and the upper cam member during a portion of a return of the lower binder and the lower cam member.

* * * * *